US008759702B2

(12) United States Patent
Huang et al.

(10) Patent No.: US 8,759,702 B2
(45) Date of Patent: Jun. 24, 2014

(54) KEY STRUCTURE AND KEYBOARD

(75) Inventors: Yao-Lun Huang, New Taipei (TW); Yeong-Sheng Jang, New Taipei (TW)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 164 days.

(21) Appl. No.: 13/543,878

(22) Filed: Jul. 8, 2012

(65) Prior Publication Data

US 2013/0087440 A1 Apr. 11, 2013

(30) Foreign Application Priority Data

Oct. 11, 2011 (CN) ..... 2011 1 0305500

(51) Int. Cl.
*H01H 13/14* (2006.01)

(52) U.S. Cl.
USPC ..... 200/344; 200/314

(58) Field of Classification Search
USPC ..... 200/344, 314, 310, 330, 343, 5 A
See application file for complete search history.

(56) References Cited

U.S. PATENT DOCUMENTS

| | | | | |
|---|---|---|---|---|
| 6,833,522 | B1 * | 12/2004 | Park et al. | 200/344 |
| 6,858,812 | B2 * | 2/2005 | Sasaki et al. | 200/344 |
| 8,222,545 | B2 * | 7/2012 | Tsai | 200/5 A |
| 8,383,971 | B2 * | 2/2013 | Liu | 200/310 |
| 8,581,127 | B2 * | 11/2013 | Jhuang et al. | 200/314 |

FOREIGN PATENT DOCUMENTS

| | | |
|---|---|---|
| TW | 468833 | 12/2001 |
| TW | 509955 | 11/2002 |

* cited by examiner

*Primary Examiner* — Felix O Figueroa
(74) *Attorney, Agent, or Firm* — Li & Cai Intellectual Property (USA) Office

(57) ABSTRACT

The present invention relates to a key structure and a keyboard having the same. The key structure includes a seat, a conductive membrane disposed on the seat, a scissor assembly, a light source, and a cap. The seat has a plurality of protruding hooking portions. At least one conducting section is defined on the conductive membrane away from the central portion thereof. The collapsible scissor assembly is arranged between the seat and the cap. The key structure has at least one protrusion arranged above the corresponding conducting section. A rubber element having a hole formed on the top portion thereof is disposed centrally on the conductive membrane. The light source is arranged beneath and covered by the rubber element. The cap is disposed on the scissor assembly. The protrusion may be arranged on the side portion of the scissor assembly or the undersurface of the cap.

20 Claims, 10 Drawing Sheets

KEY STRUCTURE AND KEYBOARD

BACKGROUND OF THE INVENTION

1. Field of the Invention

The present invention relates to a key structure and a keyboard having the same; more particular, to a key structure having a scissor assembly and a corresponding keyboard having a backlight, suitable for being adapted in laptop computers.

2. Description of Related Art

As people rely more on computers for daily life, computers are being used under various conditions and environments. For using in shaded areas where lighting is insufficient, keyboards with backlights have been developed to fit the needs.

A key of a conventional illuminated keyboard typically employs a rubber dome arranged like an inverted cup underneath a key cap. The inner bottom portion of the cup is often a closed-ended structure and is usually provided with a conducting pad. When the key cap is pressed, the conducting pad of the rubber dome is depressed and thus establishes electric contact with a conducting circuit, thereby causing the generation of a key stroke signal. Thus, for illuminated keyboard structures that employ backlight outlets underneath the keycaps, the conventional cup-shaped rubber dome will inevitably block the light output of the backlight unit. In addition, the conducting circuit (or conducting section) is also arranged directly below the rubber dome. Such arrangements adversely affect the lighting efficiency of the backlight to the central portion of the key cap. This deficiency led to insufficient and uneven distribution of lighting for the illuminated key structures. Please refer to FIG. 9. A Taiwan patent (patent # TW468833) disclosed an "Improved Light Source Displaying Structure for Keyboard". The related disclosure discloses a key structure that, when a key cap 24 is pressed, a pivoting mechanism 22 is collapsed by the movement of a sliding portion 222. The collapse of the pivoting mechanism 22 also forces a conducting portion 231 of a flexible conducting member 23 to pass through a thru-hole 213 of a fixing member 21 and abut pre-arranged electrical circuits on a first circuit board 13 to transfer the keying command.

The abovementioned disclosure further includes a display area 121 defined on a substrate 12 for a corresponding key structure 2. Alternatively, a via hole may be formed on any end of the substrate 12. A corresponding light source 141 for the display area 121 may be a luminescence plate or an LED. As can be seen from FIG. 9 and the descriptions, the light source 141 is arranged directly below the flexible conducting member 23. However, the overlapped configuration reduces the light-emitting efficiency of the keyboard.

Please refer to FIG. 10. Another Taiwan patent (patent # TW509955) disclosed an illuminated keyboard 20, which comprises a key switch 22 and a backlight device 23. The key switch 22 is disposed on the housing (not shown) of the illuminated keyboard 20. The key switch 22 includes a seat 222, a membrane circuit board 223, at least one cap 224, at least one elastic member 221, and at least one connecting assembly 225. The seat 222 is provided with a plurality of fixed members 2221. One end of the connecting assembly 225 is connected to fixed members 2221 of the seat 222 in a slideable and rotatable manner, and the other end of the connecting assembly 225 is connected to the cap 224. Thus, the cap 224 can move upward or downward relative to the seat 222. The elastic member 221 is disposed between the membrane circuit board 223 and the cap 224 to support the cap 224. The seat 222 further includes a first through hole 2222 formed thereon corresponding to the elastic member 221.

Please refer back to FIG. 10. The backlight device 23 is disposed beneath the key switch 22 to illuminate it from the bottom thereof The backlight device 23 comprises a light guide 231, a reflector plate 232, and a light source 233. A person skilled in the art can realize the light emission from the backlight device 23 is directly beneath the elastic member 221. However, because light projection is overlapped by the conducting section of the membrane circuit board 223, light projection is partially blocked which reduces the lighting performance. In addition, light beams from the LED for the above-mentioned illuminated keyboard tend to escape from the slit between the cap and the seat, causing visual discomfort to the user.

To address the aforementioned issue of uneven brightness for the keyboard, the arrangement of the light source for the backlight needs to be adjusted. An alternative means is to increase the number of LEDs to enhance the lighting effect. However, both methods are only reactive remedies and raise the manufacturing cost.

To address the above issues, the inventors strive via industrial experience and academic research to present the present invention, which can effectively improve the limitations described above.

SUMMARY OF THE INVENTION

The present invention provides a key structure and an illuminated keyboard having the same, for improving light distribution and brightness and reducing light leakage.

The key structure comprises a seat, a conductive membrane, a scissor assembly, a light source, and a cap. The seat has a plurality of protruding hooking portions. The conductive membrane is disposed on the seat, and the conductive membrane has a plurality of openings formed thereon for exposing the hooking portions. At least one pre-determined conducting section is defined on the conductive membrane away from the central portion thereof. The scissor assembly includes a first retainer and a second retainer. Two shafts are protruded from opposite sides of the first retainer. Correspondingly, two shaft holes are formed on opposite sides of the second retainer. These shafts are received by the shaft holes, and one side of the first and second retainer is hinged to the hooking portions. The second retainer has at least one protrusion arranged above the conducting section. A rubber element is disposed on the central portion of the conductive membrane. The light source is covered beneath the rubber element, and the cap is disposed on the scissor assembly.

According to the present invention, a keyboard having a plurality of key structures is also provided. Each key structure comprises a seat, a conductive membrane, a scissor assembly, a light source, and a cap. The seat has a plurality of protruding hooking portions. The conductive membrane is disposed on the seat, and the conductive membrane has a plurality of openings formed thereon for exposing the hooking portions. At least one conducting section is defined on the conductive membrane away from the central portion thereof. The scissor assembly includes a first retainer and a second retainer. Two shafts are protruded from opposite sides of the first retainer. Correspondingly, two shaft holes are formed on opposite sides of the second retainer. These shafts are received by the shaft holes, and one side of the first and second retainer is hinged to the hooking portions. The second retainer has at least one protrusion arranged above the conducting section. A rubber element having a hole formed on the top portion thereof is disposed on the central portion of the conductive membrane. The light source is covered beneath the rubber element, and the cap is disposed on the scissor assembly. Light beams emanating from the light source are directed to the cap through the hole.

The present invention has the following advantages. By aligning the light source with the central portion of the key structure, using the hollow rubber element, and arranging the conducting section outside of the rubber element, the lack of uniform light distribution and brightness for the central portion and the periphery of the key structure for the illuminated keyboard can be improved.

In order to further appreciate the characteristics and technical contents of the present invention, references are hereunder made to the detailed descriptions and appended drawings in connection with the present invention. However, the appended drawings are merely shown for exemplary purposes, rather than being used to restrict the scope of the present invention.

DETAILED DESCRIPTION OF EMBODIMENTS

Figure 1:
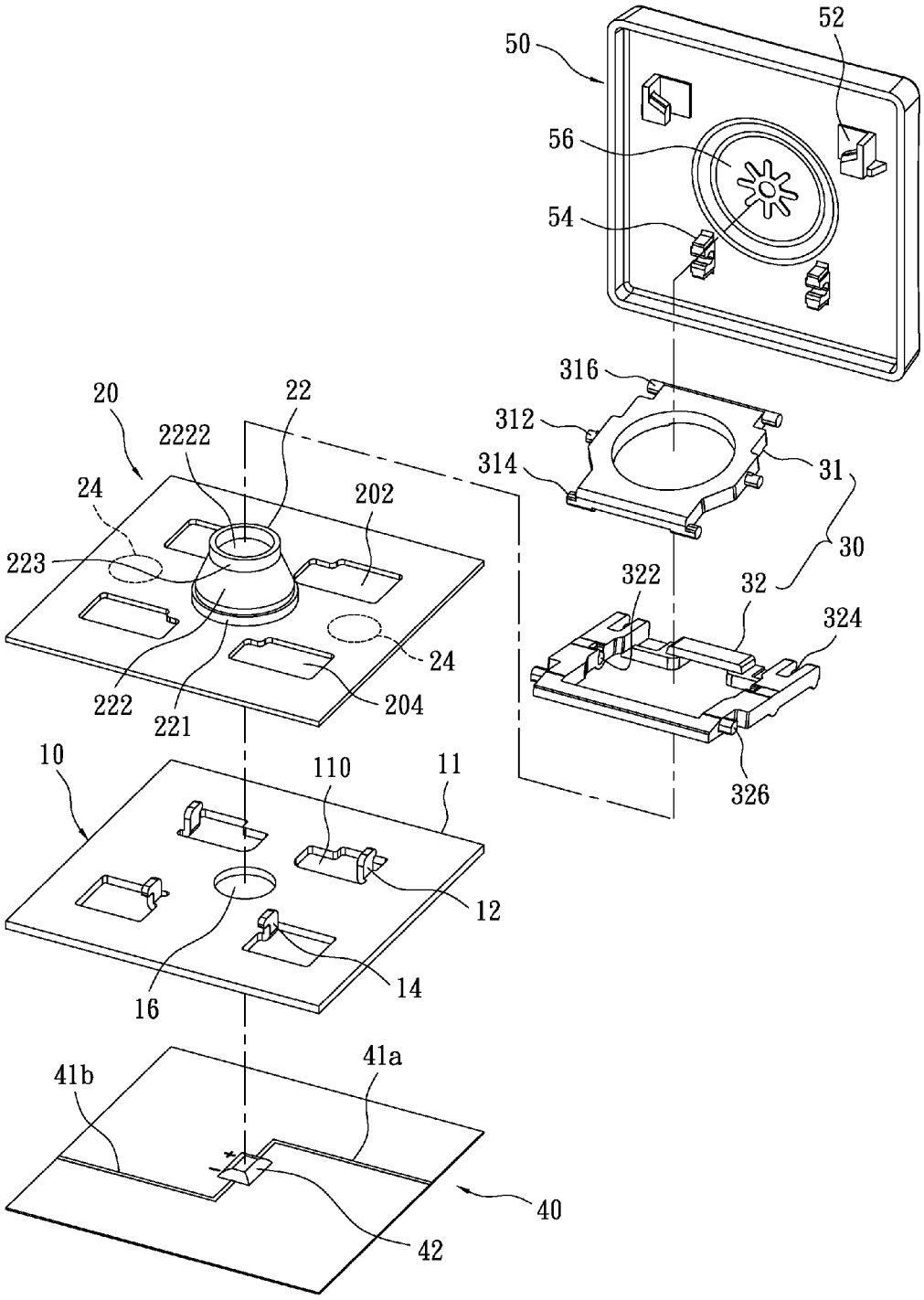
FIG. 1 is an exploded view of a key structure of the present invention.
Figure 3:
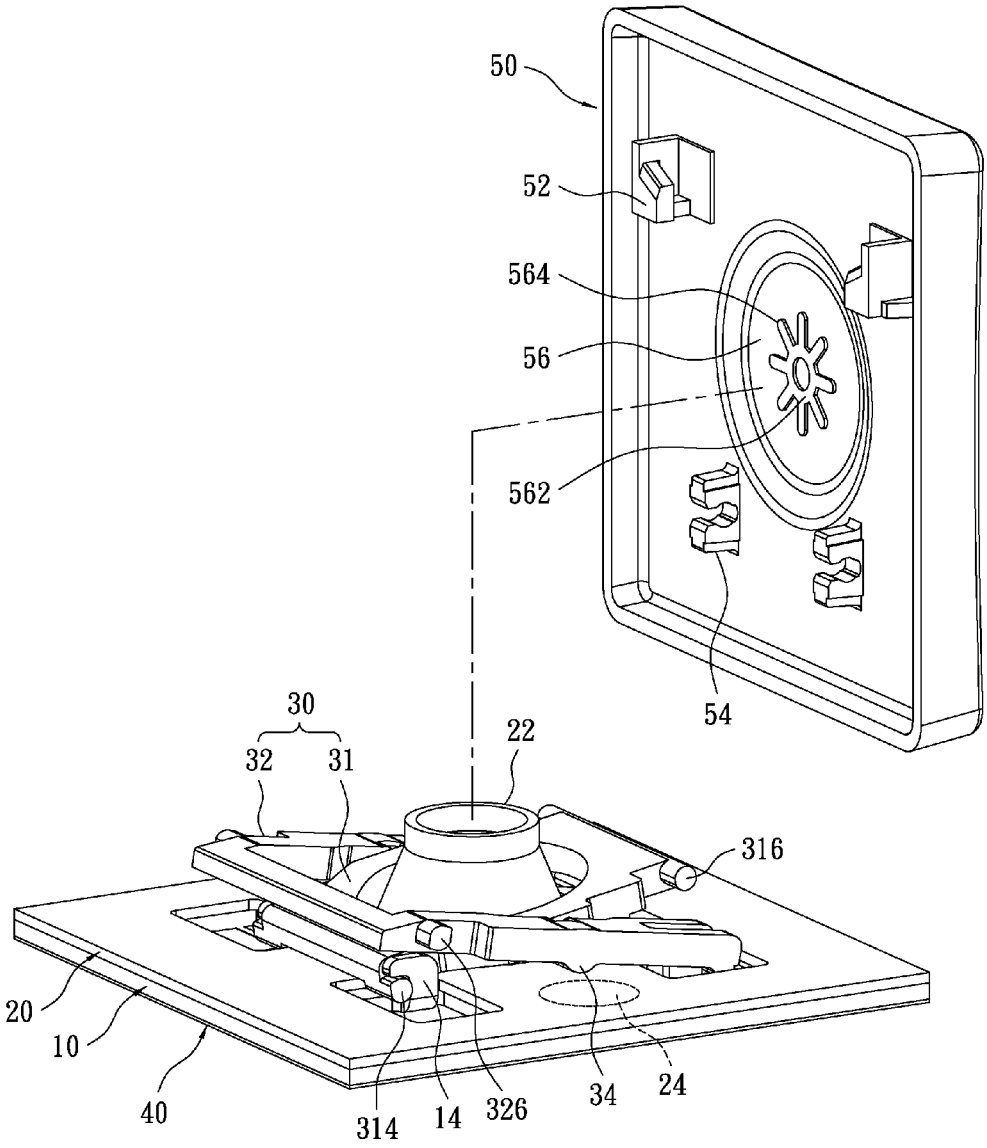
FIG. 3 is a perspective view of the key structure of the present invention with the cap being disengaged.

Please refer to FIG. 1, which shows an exploded view of a key structure of the present invention. The key structure comprises a seat 10, a conductive membrane 20, a scissor assembly 30, and a cap 50. A hollow rubber element 22 is disposed on the conductive membrane 20. The rubber element 22 has a hole 2222 formed on the top portion thereof A light source 42, such as a light-emitting diode (LED), is arranged underneath the rubber element 22. Light beams emanating from the light source 42 are directed onto the cap 50 through the hole 2222 of the rubber element 22. In the instant embodiment, the rubber element 22 and the light source 42 are particularly aligned with the central portion of the conductive membrane 20. Correspondingly, a predetermined conducting section 24 on the conductive membrane 20 is defined away from the central portion thereof. In other words, the conducting section 24 is defined outside of the rubber element 22. The key structure has at least one conducting section 24, for providing electrical communication with a corresponding protrusion 34 (FIG. 3). Since the rubber element 22 is hollow and open-ended with the hole 2222, all light beams can be directed to the central portion underneath the cap 50. The bottom structure on the undersurface of the cap 50 can disperse the light beams uniformly. Thereby, the present invention is able to enhance the brightness of the backlit keyboard. Namely, light beams are directed to the cap 50 through the hole 2222 of the rubber element 22. The light intensity is strong enough and the light beams can be evenly dispersed. In addition, the aforementioned light leakage issue associated with the related art can be eliminated. In conjunction with related figures, some embodiments of the present invention are discussed hereinbelow.

The aforementioned seat 10 has a plurality of protruding hooking portions 12, 14 for engaging the underside of the scissor assembly 30. The seat 10 is preferably made of metal plate, and the hooking portions 12, 14 are formed integrally with the seat 10 by the stamping process. Punched holes 110 are formed adjacently to the corresponding hooking portions 12, 14. For the embodiment shown in FIG. 1, the light source 42 is a light-emitting diode (LED) mounted on a membrane 40. For supplying electrical power, the membrane 40 is disposed beneath the seat 10. The light source 42 is arranged directly underneath the cap 50, and a via-hole 16 is formed on the seat 10 in correspondence to the light source 42.

For the instant embodiment, the membrane 40 can be a Mylar film having a pair of conductive traces 41*a*, 41*b* disposed thereon. The electrodes of the LED are electrically connected to the corresponding conductive traces 41*a*, 41*b*, and the LED is encapsulated on the membrane 40. The membrane 40 also serves as a seal against moisture penetration. However, the arrangement of the light source 42 is not restricted to the above manner. For example, the LED may be directly mounted on the conductive membrane 20. The conductive membrane 20 is provided with a pair of conductive traces (not shown) for connecting electrically to the LED.

Figure 2:
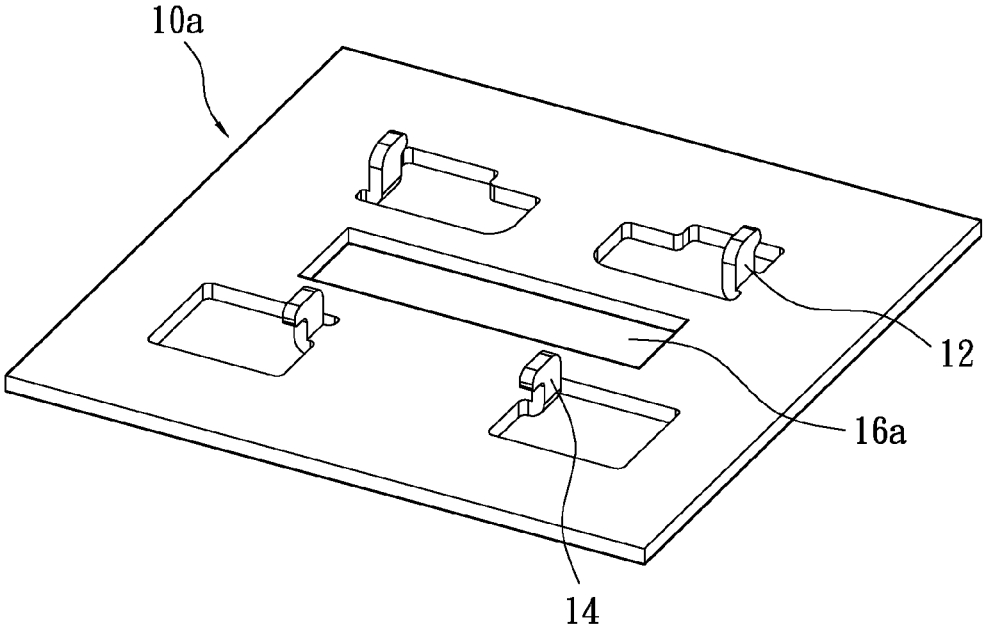
FIG. 2 is a perspective view of an alternative seat for the key structure of the present invention.

The exact physical arrangement of the seat 10 is not restricted. For example, the via-hole 16 is not restricted to a circular shape as shown in FIG. 1. For instance, as shown in FIG. 2, a rectangular via-hole 16*a* may be formed on a seat 10*a*.

Please refer back to FIG. 1. The conductive membrane 20 is disposed on the seat 10 and can be made of Mylar. The rubber element 22 is disposed on the central portion of the conductive membrane 20. The conductive membrane 20 has a plurality of openings 202 and 204 formed thereon for exposing the hooking portions 12 and 14, and the conductive membrane 20 also has two conducting sections 24 defined thereon away from the central portion thereof. Particularly, the conducting sections 24 are defined on the top surface of the conductive membrane 20 toward the edge thereof. When the conducting sections 24 are being pressed, an electrical signal is generated. The conducting section 24 is a structure typically sandwiched and electrically connected between two circuit layers (as shown in FIG. 5A) on a thin-film circuit board.

The scissor assembly 30 includes a first retainer 31 and a second retainer 32. The rubber element 22 penetrates through the scissor assembly 30. The first retainer 31 has a pair of shafts 312 protruding from opposite side portions thereof Correspondingly, the second retainer 32 has a pair of shaft holes 322 formed on opposite side portions thereof for receiving the shafts 312. The first and second retainers 31, 32 each has one end hinged to the hooking portions 12, 14. Specifically, the first retainer 31 has a pair of bottom shafts 314 formed on one end thereof oppositely hinged to the hooking portions 14. Whereas the second retainer 32 has a pair of bottom shafts 324 formed on one end thereof oppositely hinged to the hooking portions 12.

Please refer to FIGS. 1 and 3. The cap 50 is disposed on the scissor assembly 30. The cap 50 has a pair of restricting members 52 and a pair of pivoting members 54 on the bottom surface thereof. The first retainer 31 has a pair of top shafts 316 formed on another end thereof oppositely and pivotally connected to the pivoting members 54. Whereas the second retainer 32 has a pair of top shafts 326 formed on another end thereof oppositely and received by the restricting members 52. As shown in FIG. 3, the cap 50 has a substantially star-shaped breathable structure 56 formed on the bottom surface thereof. The breathable structure 56 has a ring portion 562 and a plurality of branch portions 564 extending therefrom. When the cap 50 is pressed or the rubber element 22 is released, air can flow in or out of the rubber element 22 between the branch portions 564 of the breathable structure 56. In addition, the cap 50 has a ring-shaped light-guiding structure (not labeled) formed on the periphery of the breathable structure 56 to uniformly disperse the light beams across the cap 50.

Figure 4:
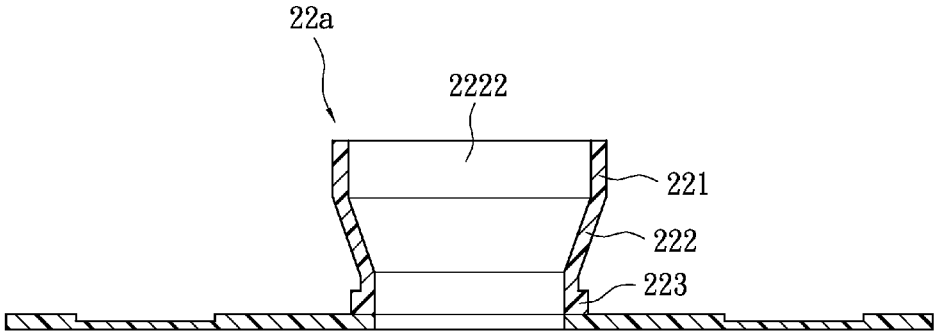
FIG. 4 is a cross-sectional view of an alternative rubber element for the key structure of the present invention.

Please refer back to FIG. 1. The rubber element 22 of the present embodiment has an annular portion 221 disposed on the conductive membrane 20, a barrel-shaped connecting portion 222 extending from the annular portion 221, and a ring portion 223 formed on one end of the connecting portion 222 abutting to the bottom surface of the cap 50. The breathable structure 56 is arranged in correspondence to the ring portion 223. The connecting portion 222 gradually tapers in a direction toward the cap 50. However, the structural configuration of the connecting portion 222 is not restricted thereto. For example, the rubber element 22 can be flipped in its orientation as shown in FIG. 4. In FIG. 4, a rubber element 22*a* gradually tapers in a direction toward the conductive membrane 20. For this orientation, the hole 2222 is larger in providing light output. The rubber element 22 is preferably made of non light-permitting material to confine light beams therewithin. The rubber element 22 may be secured to the conductive membrane 20 by adhesives. Alternatively, multiple rubber elements 22 may be integrally formed in one piece on a generic plate and disposed on the conductive membrane 20.

Please refer back to FIG. 3. The scissor assembly 30 has two protrusions 34 formed integrally thereon, in corresponding to the conducting sections 24 outside of the rubber element 22. The protrusions 34 are formed on opposite sides beneath the scissor assembly 30. More specifically, the protrusions 34 are formed on opposite sides of the undersurface of the second retainer 32.

Figure 5:
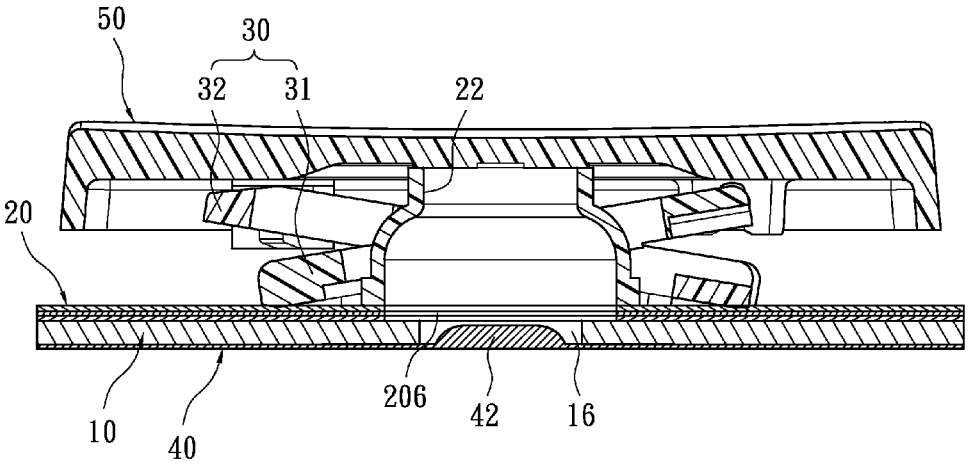
FIG. 5 is a cross-sectional view of the key structure of the present invention.
Figure 5A:
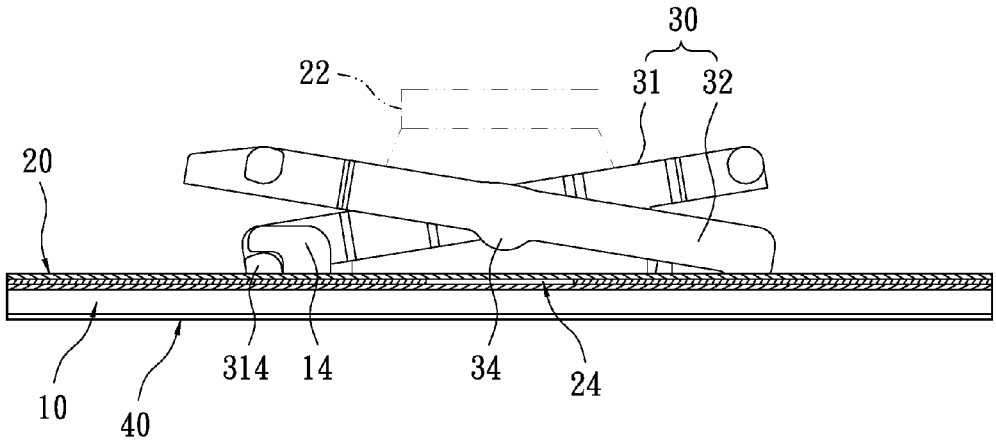
FIG. 5A is a side view of the key structure of the present invention when the key is not pressed.
Figure 5B:
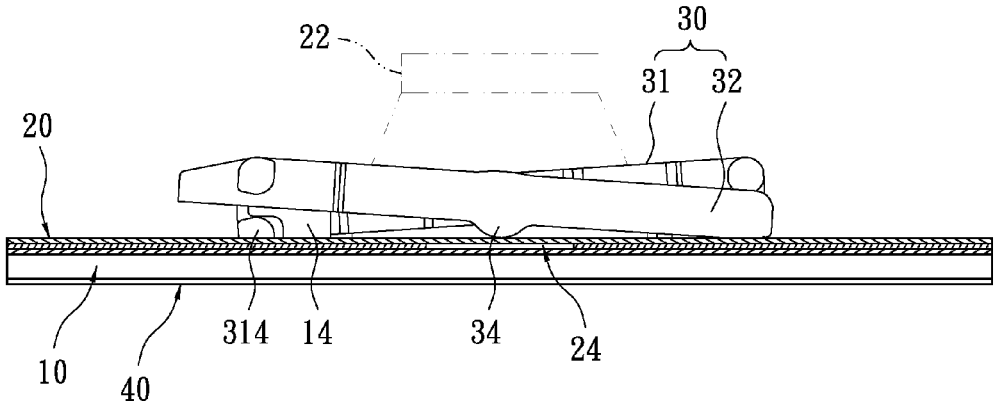
FIG. 5B is a side view of the key structure of the present invention when the key is pressed.

Please refer to FIGS. 5~5B. FIG. 5 is a cross-sectional view of the key structure before being pressed. FIGS. 5A and 5B are schematic views (without the cap 50) of the key structure before and after touching the conducting sections 24, respectively. As shown in FIG. 5, the conductive membrane 20 has a light-permitting hole 206 formed thereon in corresponding to the base of the rubber element 22, such that light beams from the light source 42 may pass through the conductive membrane 20. The size of the light-permitting hole 206 is the same as the opening of the base of the rubber element 22 on the conductive membrane 20. The above configuration further allows light beams to be directly projected to the undersurface of the cap 50 in an obstruction-less manner. Nevertheless, the conductive membrane 20 is usually light-permitting, thus, the omission of the light-permitting hole 206 on the conductive membrane 20 is also allowable. When the key structure is being pressed, the scissor assembly collapses accordingly, where the protrusions 34 of the second retainer 32 presses onto the conducting sections 24 to enable signal communication. Concurrently, the rubber element 22 is substantially deformed, as shown by the dashed lines in the figures.

Figure 6:
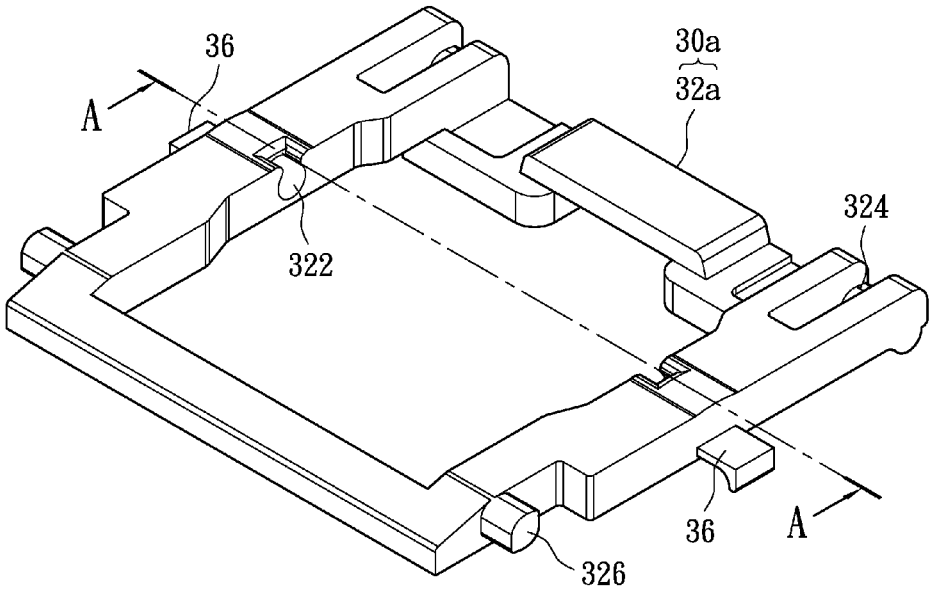
FIG. 6 is a perspective view of an alternative second retainer for the key structure of the present invention.
Figure 7:
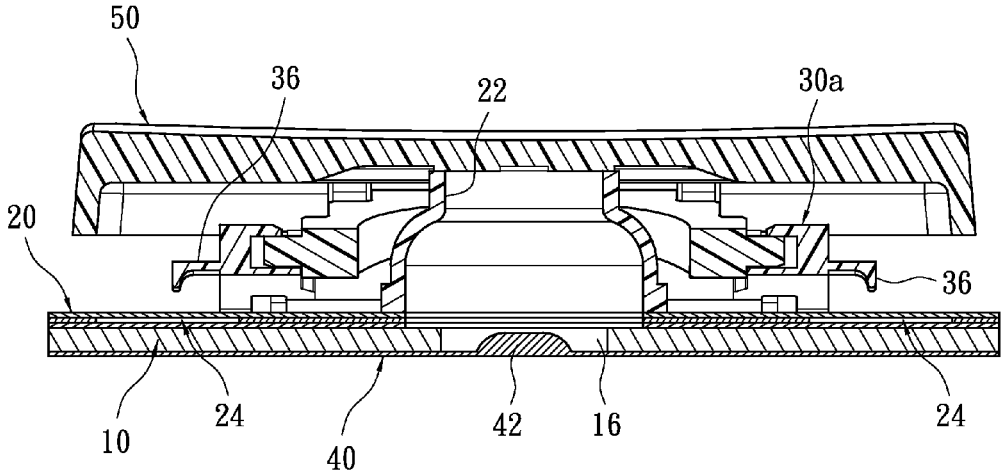
FIG. 7 is a cross-sectional view of the alternative second retainer for the key structure of the present invention.
Figure 7A:
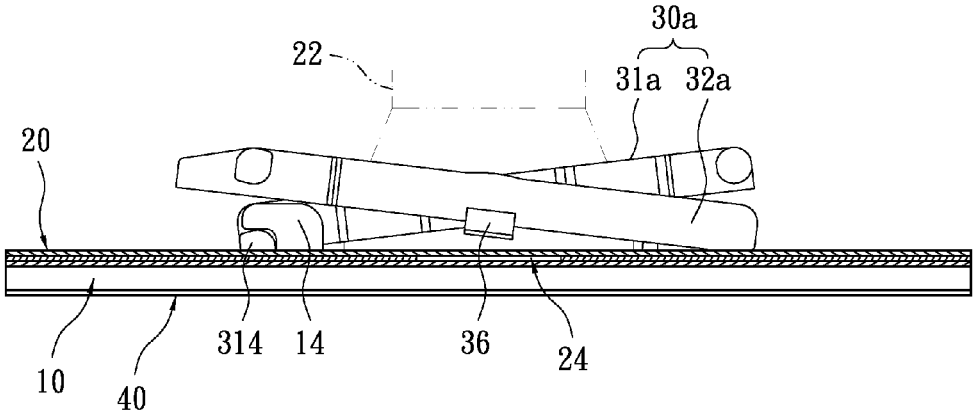
FIG. 7A is a side view of the key structure of the present invention having the alternative second retainer when the key is not pressed.
Figure 7B:
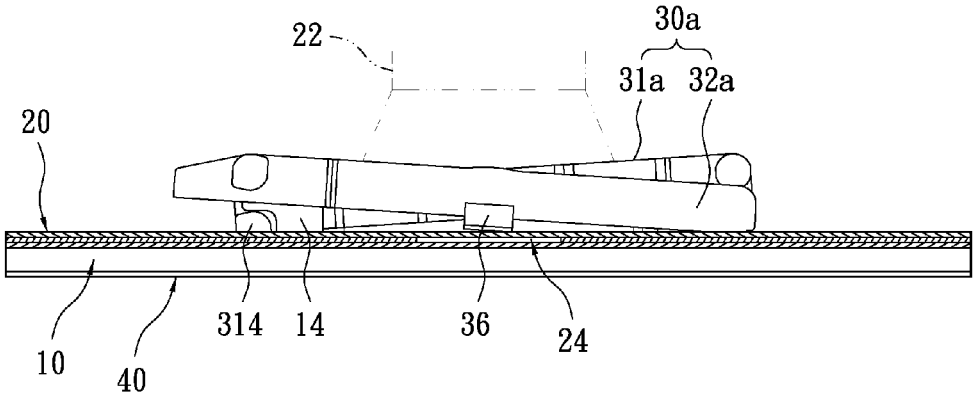
FIG. 7B is a side view of the key structure of the present invention having the alternative second retainer when the key is pressed.

Please refer to FIG. 6, which shows an alternative design of the second retainer 32*a*. This second retainer 32*a* of the scissor assembly 30*a* is provided with a pair of different protrusions 36 extending sideways thereof. FIG. 7 shows a cross-sectional view of the key structure taken along line A-A in FIG. 6. The protrusions 36 extend outwardly from the retainer 32*a* above the conducting sections 24. As shown in FIGS. 7A and 7B, when the key structure is pressed, the protrusions 36 of the second retainer 32*a* press onto the conducting sections 24 to generate an electrical signal.

Based on the above descriptions, the protrusions 34, 36 only need to be above the conducting sections 24. Another option is to arrange the protrusions on the undersurface of the cap 50. For example, a pair of column-shaped protrusions may be formed underneath the cap 50. When the key structure is pressed, the cap 50 lowers and presses onto the conducting sections 24.

Figure 8:
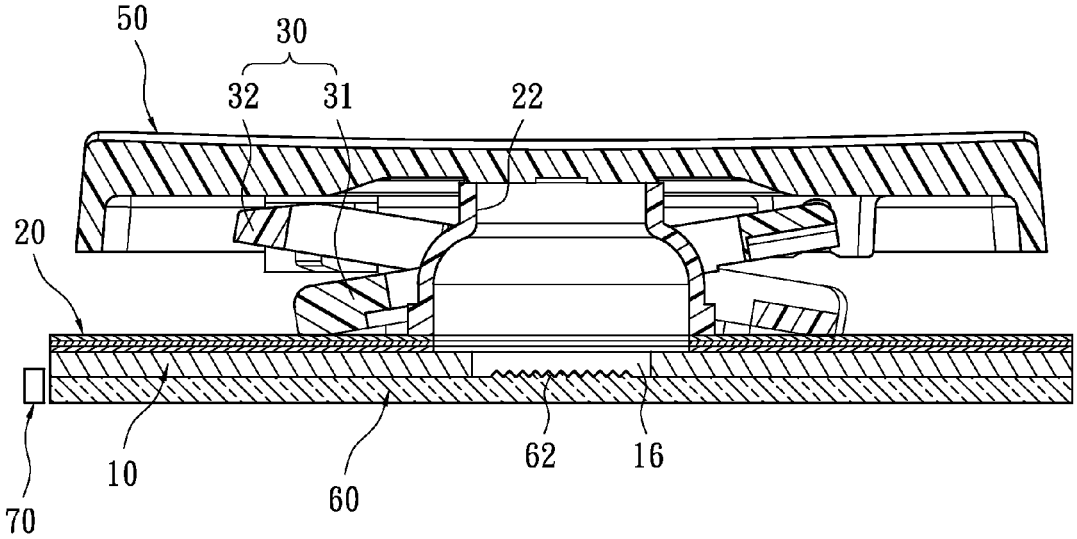
FIG. 8 is a cross-sectional view of the key structure of the present invention having an alternative lighting arrangement.
Figure 9:
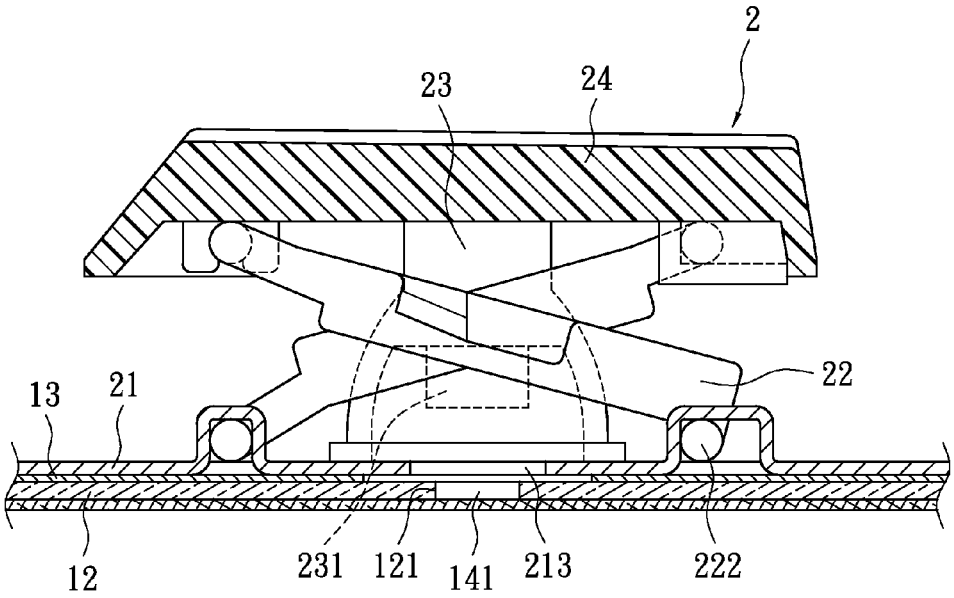
FIG. 9 RELATED ART
FIG. 9 is a side view of a key structure of a related art.
Figure 10:
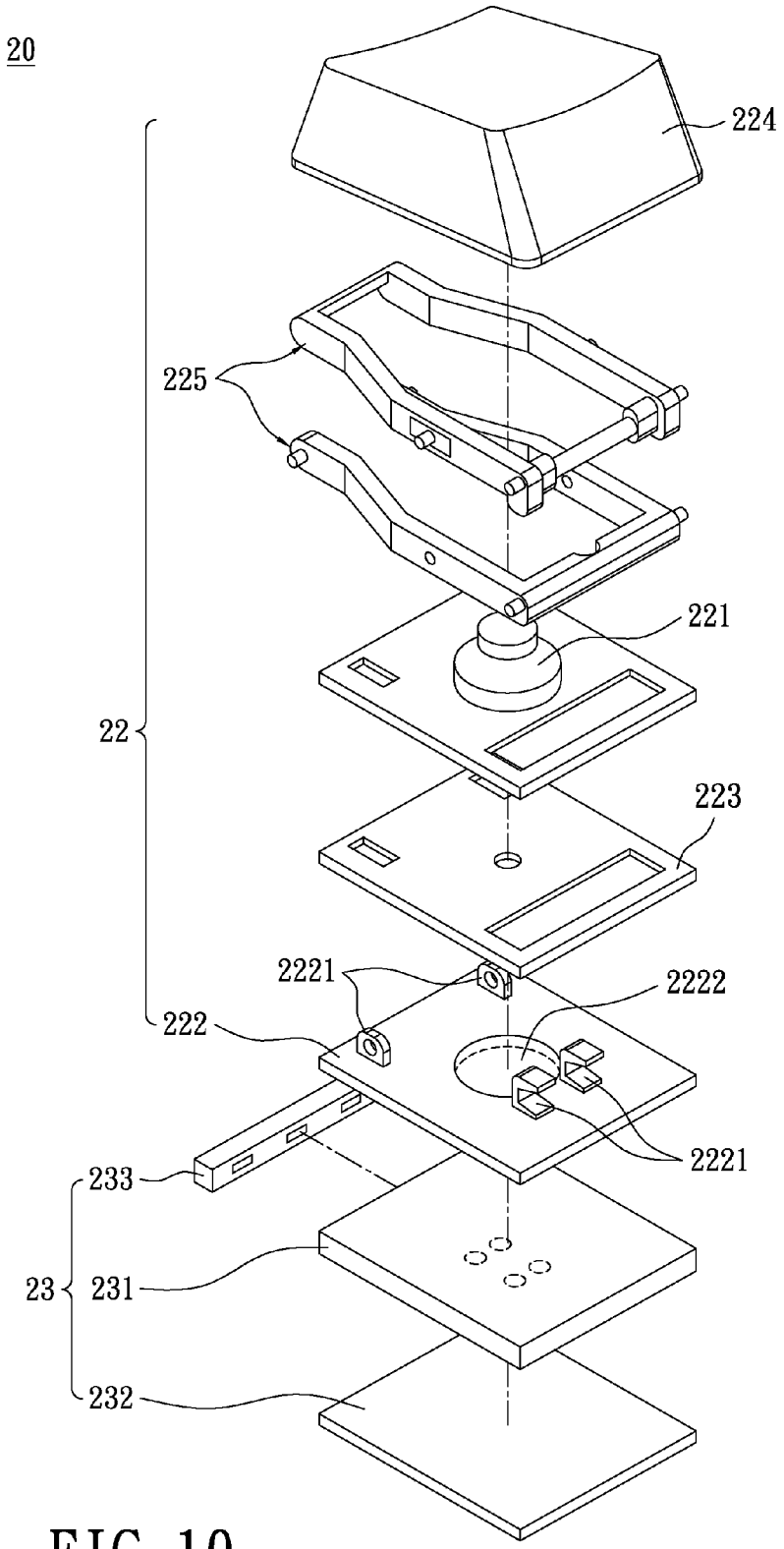
FIG. 10 RELATED ART
FIG. 10 is an exploded view of a key structure for another related art.

Please refer to FIG. 8, which shows an alternative light source for the key structure of the present invention. A light-guiding film 60 is disposed under the seat 10, and an LED 70 is disposed besides the light-guiding film 60. The light-guiding film 60 has a light-guiding microstructure 62 formed thereon and under the rubber element 22. The light-guiding microstructure 62 guides the light from the LED 70 and acts as a light source. The seat 10 has a via hole 16 formed thereon in corresponding to the light-guiding microstructure 62. Light beams emanating from the LED 70 propagate in the light-guiding film 60 by total internal reflection. When the light beams reach the light-guiding microstructure 62, the light beams are directed outward onto the rubber element 22 to illuminate the cap 50.

The provided figures only show the key structure of the present invention. Nevertheless, the present invention can be used on a keyboard, where each key on the keyboard has the above-described structural configuration.

The key structure and the keyboard having the same of the present invention have the following technical features and attributes. The light source is disposed on the central portion of the key structure, where the conducting sections are relocated to be outside of the hollow rubber element. Thus, light intensity and uniform light distribution for the central portion and periphery of the key structure can be improved.

In addition, the hole of the rubber element guides the light beams completely to the undersurface of the cap. The rubber element acts as a light shield to confine the light therein.

Even more suitable for elongated key structures, the conducting sections of the present invention are relocated from the central portion toward the edge portion of the key structure. The scissor assembly or the cap has the protrusions formed on the undersurface thereof for enabling electrical communication with the conducting sections.

Moreover, regarding the light source, the formation of the via hole on the seat expands the passage traveled by the light emanating from the light source. Thereby, the illumination intensity of the cap is enhanced and the light beams are more evenly distributed on the cap.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the present invention delineated by the following claims.

What is claimed is:

1. A key structure, comprising:

a seat having a plurality of protruding hooking portions;

a conductive membrane disposed on the seat, wherein the conductive membrane has a plurality of openings formed thereon for exposing the hooking portions, wherein the conductive membrane further has at least one pre-determined conducting section defined thereon peripherally;

a scissor assembly having a first retainer and a second retainer, wherein the first retainer has a pair of shafts protruding outwardly from opposite sides thereof, wherein the second retainer has a pair of shaft holes formed on opposite side thereof and at least one protrusion arranged above the corresponding conducting section, wherein the shafts are received by the corresponding shaft holes, wherein the first retainer and the second retainer each has one end hinged to the corresponding hooking portions of the seat;

a rubber element disposed centrally on the conductive membrane, wherein the rubber element is open-ended having a hole formed on one end thereof away from the seat;

a light source disposed under and covered by the rubber element; and a cap disposed on the scissor assembly, wherein the light from the light source is directed to the cap through the hole.

2. The key structure of claim 1, further comprising a Mylar-grade membrane for sealing against moisture and supplying electrical power under the rubber element, wherein the light source is a light-emitting diode (LED) disposed on the membrane, and wherein the seat has a via-hole formed thereon corresponding to the light source.

3. The key structure of claim 1, further comprising a light-guiding film underneath the seat and an LED arranged beside the light-guiding film, wherein a light-guiding microstructure is formed on the light-guiding film for guiding the light from the LED, and wherein the seat has a via-hole formed thereon corresponding to the light-guiding microstructure.

4. The key structure of claim 1, wherein the light source is an LED disposed on the conductive membrane.

5. The key structure of claim 1, wherein a pair of pre-determined conducting sections is defined on the conductive membrane outside of the rubber element, and wherein the scissor assembly has a pair of protrusions integrally formed therewith above the corresponding conducting sections.

6. The key structure of claim 5, wherein the protrusions are formed convexly on the undersurface of the scissor assembly oppositely.

7. The key structure of claim 5, wherein the protrusions protrude outwardly from opposite sides of the scissor assembly.

8. The key structure of claim 1, wherein a pair of pre-determined conducting sections is defined on the conductive membrane outside of the rubber element, and wherein a pair of protrusions is formed on the undersurface of the second retainer above the corresponding conducting sections.

9. The key structure of claim 1, wherein the rubber element has an annular portion arranged on the conductive membrane, a barrel-shaped connecting portion extending from the annular portion, and a ring portion connected to the other end of the connecting portion abutting to the cap.

10. The key structure of claim 9, wherein a breathable structure is formed on the undersurface of the cap corresponding to the ring portion of the rubber element.

11. An user input device, comprising:

at least one key structure, wherein the key structure includes:

a seat having a plurality of protruding hooking portions;

a conductive membrane disposed on the seat, wherein the conductive membrane has a plurality of openings formed thereon for exposing the hooking portions, wherein the conductive membrane further has at least one pre-determined conducting section defined thereon peripherally;

a scissor assembly having a first retainer and a second retainer, wherein the first retainer has a pair of shafts protruding outwardly from opposite sides thereof, wherein the second retainer has a pair of shaft holes formed on opposite side thereof and at least one protrusion arranged above the corresponding conducting section, wherein the shafts are received by the corresponding shaft holes, wherein the first retainer and the second retainer each has one end hinged to the corresponding hooking portions of the seat;

a rubber element disposed centrally on the conductive membrane, wherein the rubber element is open-ended having a hole formed on one end thereof away from the seat;

a light source disposed under and covered by the rubber element; and a cap disposed on the scissor assembly, wherein the light from the light source is directed to the cap through the hole.

12. The key structure of claim 11, further comprising a Mylar-grade membrane for sealing against moisture and supplying electrical power under the rubber element, wherein the light source is a light-emitting diode (LED) disposed on the membrane, and wherein the seat has a via-hole formed thereon corresponding to the light source.

13. The key structure of claim 11, further comprising a light-guiding film underneath the seat and an LED arranged beside the light-guiding film, wherein a light-guiding microstructure is formed on the light-guiding film for guiding the light from the LED, and wherein the seat has a via-hole formed thereon corresponding to the light-guiding microstructure.

14. The key structure of claim 11, wherein the light source is an LED disposed on the conductive membrane.

15. The key structure of claim 11, wherein a pair of pre-determined conducting sections is defined on the conductive membrane outside of the rubber element, and wherein the scissor assembly has a pair of protrusions integrally formed therewith above the corresponding conducting sections.

16. The key structure of claim 15, wherein the protrusions are formed convexly on the undersurface of the scissor assembly oppositely.

17. The key structure of claim 15, wherein the protrusions protrude outwardly from opposite sides of the scissor assembly.

18. The key structure of claim 11, wherein a pair of pre-determined conducting sections is defined on the conductive membrane outside of the rubber element, and wherein a pair of protrusions is formed on the undersurface of the second retainer above the corresponding conducting sections.

19. The key structure of claim 11, wherein the rubber element has an annular portion arranged on the conductive membrane, a barrel-shaped connecting portion extending from the annular portion, and a ring portion connected to the other end of the connecting portion abutting to the cap.

20. The key structure of claim 19, wherein a breathable structure is formed on the undersurface of the cap corresponding to the ring portion of the rubber element.

* * * * *